US012622554B2

(12) United States Patent
Choi et al.

(10) Patent No.: US 12,622,554 B2
(45) Date of Patent: May 12, 2026

(54) VACUUM CLEANER

(71) Applicant: Samsung Electronics Co., Ltd., Suwon-si (KR)

(72) Inventors: Jiwon Choi, Suwon-si (KR); Byoungin Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 423 days.

(21) Appl. No.: 18/312,042

(22) Filed: May 4, 2023

(65) Prior Publication Data

US 2023/0270302 A1 Aug. 31, 2023

Related U.S. Application Data

(63) Continuation of application No. PCT/KR2021/012835, filed on Sep. 17, 2021.

(30) Foreign Application Priority Data

Nov. 9, 2020 (KR) ..... 10-2020-0148762

(51) Int. Cl.
*A47L 9/06* (2006.01)
*A47L 9/04* (2006.01)

(52) U.S. Cl.
CPC ..... *A47L 9/0633* (2013.01); *A47L 9/0466* (2013.01); *A47L 9/066* (2013.01); *A47L 2201/00* (2013.01)

(58) Field of Classification Search
CPC .. A47L 11/4044; A47L 9/0633; A47L 9/0666; A47L 9/0626
See application file for complete search history.

(56) References Cited

U.S. PATENT DOCUMENTS 3,460,188 A * 8/1969 Boyd ..... A47L 5/30 15/364
4,864,682 A * 9/1989 Bewley, Jr. ..... A47L 5/34 15/364

(Continued)

FOREIGN PATENT DOCUMENTS

CN 110279354 A 9/2019
CN 211130885 U 7/2020

(Continued)

OTHER PUBLICATIONS

International Search Report dated Dec. 27, 2021, issued in International Patent Application No. PCT/KR2021/012835.

(Continued)

*Primary Examiner* — Bryan R Muller
(74) *Attorney, Agent, or Firm* — Jefferson IP Law, LLP

(57) ABSTRACT

A vacuum cleaner is provided. The vacuum cleaner includes a cleaner body generating a suction force, and a suction unit comprising a suction chamber opened to suck foreign materials by the suction force. The suction unit includes a brush drum partially protruding toward an outside of the suction chamber within the suction chamber and provided rotatably, and a blade provided to collect foreign materials as extended along an extending direction of the brush drum while being spaced apart leaving a gap from the brush drum inside the suction chamber, and including a transformable portion to be transformed to widen the gap.

13 Claims, 16 Drawing Sheets

(56) References Cited

U.S. PATENT DOCUMENTS

| | | | | | |
|---|---|---|---|---|---|
| 5,054,156 | A * | 10/1991 | Watanabe | A47L 9/0411 | 15/325 |
| 5,184,372 | A * | 2/1993 | Mache | A47L 13/11 | 15/245 |
| 5,634,239 | A * | 6/1997 | Tuvin | A47L 9/0626 | 15/415.1 |
| 7,334,284 | B2 * | 2/2008 | Grey | A47L 9/0411 | 15/83 |
| 2012/0317745 | A1 | 12/2012 | Jung et al. | | |
| 2014/0026338 | A1 | 1/2014 | Kim et al. | | |
| 2017/0273524 | A1 | 9/2017 | Klintemyr et al. | | |
| 2017/0332863 | A1 | 11/2017 | Zhang | | |
| 2019/0290086 | A1 | 9/2019 | Kim et al. | | |
| 2020/0352403 | A1 | 11/2020 | Kim | | |

FOREIGN PATENT DOCUMENTS

| | | | |
|---|---|---|---|
| KR | 10-2009-0063334 | A | 6/2009 |
| KR | 10-2011-0108761 | A | 10/2011 |
| KR | 10-2014-0015099 | A | 2/2014 |
| KR | 10-2016-0025392 | A | 3/2016 |
| KR | 10-2019-0054517 | A | 5/2019 |
| KR | 10-2019-0111526 | A | 10/2019 |

OTHER PUBLICATIONS

Korean Office Action dated Nov. 27, 2025, issued in Korean Application No. 10-2020-0148762.

* cited by examiner

VACUUM CLEANER

CROSS-REFERENCE TO RELATED APPLICATION(S)

This application is a continuation application, claiming priority under § 365(c), of an International application No. PCT/KR2021/012835, filed on Sep. 17, 2021, which is based on and claims the benefit of a Korean patent application number 10-2020-0148762, filed on Nov. 9, 2020, in the Korean Intellectual Property Office, the disclosure of which is incorporated by reference herein in its entirety.

BACKGROUND

1. Field

The disclosure relates to a vacuum cleaner. More particularly, the disclosure relates to a vacuum cleaner including an improved blade for collecting foreign materials.

2. Description of Related Art

A vacuum cleaner is provided with a suction unit including a brush drum to clean a carpet or the like floor to which foreign materials are deeply attached. The brush drum strikes a target while rotating, thereby separating the foreign materials attached to the carpet or floor from the carpet or floor. The vacuum cleaner sucks such separated foreign materials through the suction unit. In this way, the brush drum is useful when sucking the foreign materials by taking a suction port of the vacuum cleaner to a cleaning surface.

The vacuum cleaner includes a brush drum that rotates, and a blade that pushes dust on the cleaning surface. In the case of sucking general dust of fine particles, there is no problem. However, in the case of sucking hard and big foreign materials, problems arise. When a gap between the brush drum and the blade is wide, a suction force is too weak to suck such hard and big foreign materials. On the other hand, when the gap is narrowed to make the suction force strong, such foreign materials fail to pass through the gap and get stuck or are forcibly sucked stopping the operation of the brush drum or damaging the brush drum or blade.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a vacuum cleaner having improved suction power and capable of sucking big foreign materials.

Additional aspects will be set forth in part in the description which follows and, in part, will be apparent from the description, or may be learned by practice of the presented embodiments.

In accordance with an aspect of the disclosure, a vacuum cleaner is provided. The vacuum cleaner includes a cleaner body generating a suction force, and a suction unit comprising a suction chamber opened to suck foreign materials by the suction force. The suction unit includes a brush drum partially protruding toward an outside of the suction chamber within the suction chamber and provided rotatably, and a blade provided to collect foreign materials as extended along an extending direction of the brush drum while being spaced apart leaving a gap from the brush drum inside the suction chamber, and including a transformable portion to be transformed to widen the gap.

The blade includes an elastically transformable material.

The suction unit includes a brush cover provided to cover an opening of the suction chamber, and including an opening through which the brush drum partially protrudes.

The brush cover includes a blade supporter supporting the blade to be extended along a lengthwise direction of the brush drum while being spaced apart from the brush drum.

The blade includes a collector facing toward a cleaning surface to collect foreign materials, and a fixed portion integrally bent from the collector and supported on the brush cover.

The suction unit includes a blade cover fixed to the blade supporter with the blade therebetween.

The blade includes a bending connector provided between the collector and the fixed portion and spacing the collector from the blade cover.

The blade supporter includes a plurality of concave-convex (凹凸) portions provided along a lengthwise direction.

The concave-convex (凹凸) portion has an arc shape.

The concave (凹) portion may have a wider width than the convex (凸) portion.

The convex (凸) portion may have a lower portion wider than an upper portion thereof.

The brush cover includes a front supporter with the opening therebetween, and the front supporter includes a plurality of protrusions spaced apart from each other in a lengthwise direction and protruding downwards, and a plurality of passages provided between the plurality of protrusions and allowing foreign materials to be introduced.

The number of convex (凸) portions is equal to the number of protrusions.

The concave (凹) portion may be provided at a position corresponding to the passage.

A transformable portion of the blade includes a portion exposed through the concave (凹) portion.

The blade cover includes a recessed portion to accommodate a transformed portion of a transformable portion.

As described above, in the vacuum cleaner according to the disclosure, the gap between the brush drum and the blade is narrowed, and the blade is transformed in shape to easily pass a large foreign material, thereby making the suction force strong and sucking even a large foreign material.

Further, in the vacuum cleaner according to the disclosure, the brush drum or the blade is prevented from being damaged while sucking a hard and large foreign material during cleaning, thereby improving durability.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

For the understanding of the disclosure, the vacuum cleaner will be described below by taking a robot cleaner 1 of FIG. 1 as an example. However, unlike the embodiments set forth herein, it will be appreciated that the vacuum cleaner may be implemented by various alternatives, such as a canister type vacuum cleaner, an upright type vacuum cleaner, and a stick type vacuum cleaner.

Figure 1:
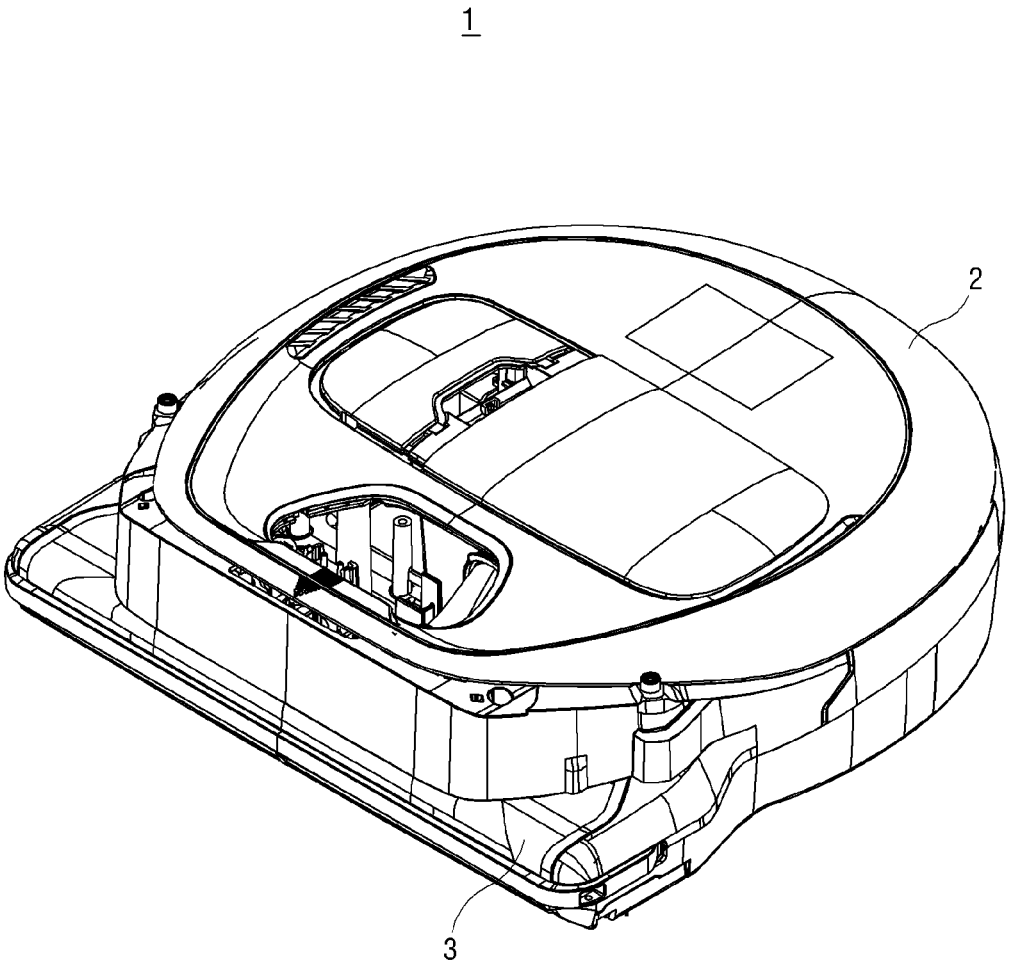
FIG. 1 is a perspective view of a vacuum cleaner viewed from above according to an embodiment of the disclosure.

FIG. 1 is a perspective view of the vacuum cleaner viewed from above according to an embodiment of the disclosure.

Figure 2:
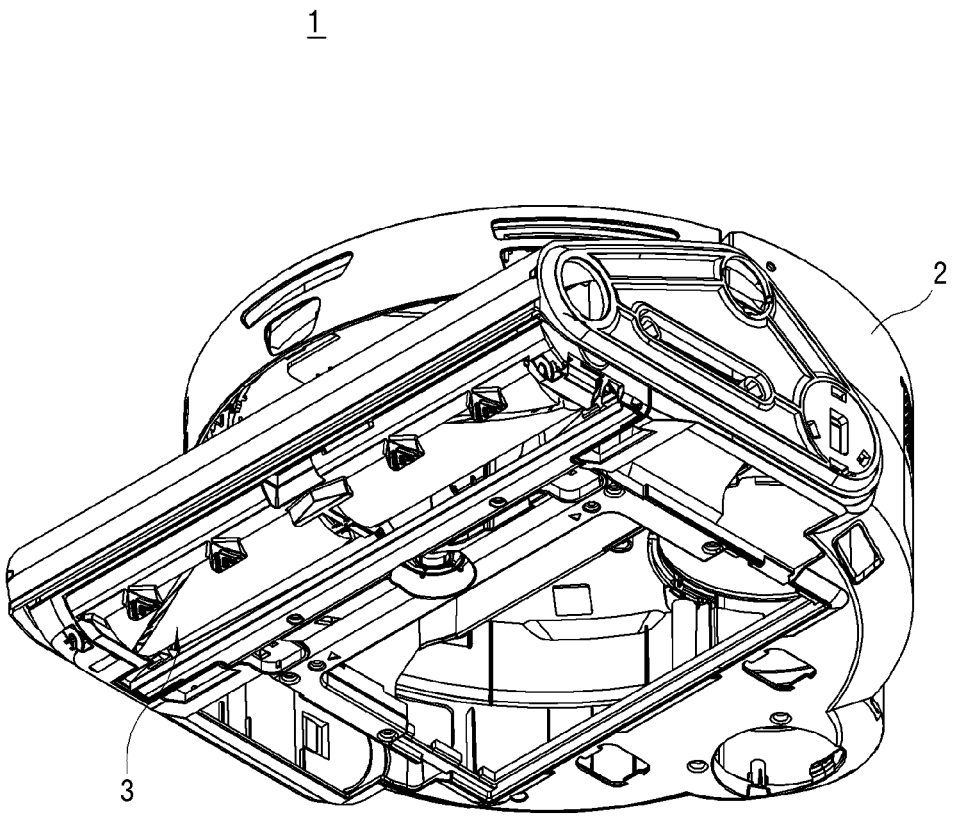
FIG. 2 is a perspective view of a vacuum cleaner viewed from below according to an embodiment of the disclosure.

FIG. 2 is a perspective view of the vacuum cleaner viewed from below according to an embodiment of the disclosure.

Referring to FIGS. 1 and 2, a vacuum cleaner 1 according to an embodiment includes a cleaner body 2, in which suction power is generated, and a suction unit 3.

The cleaner body 2 may include a suction motor for generating a suction force, and a dust collector.

The suction motor may generate a predetermined suction force to suck dust or foreign materials from a surface to be cleaned.

Dust collector may collect dust or foreign materials sucked into the cleaner body 2 through the suction unit 3 by the suction force. Dust collector may include a filter for filtering dust or foreign materials sucked by the suction force. Dust collector may have a cyclone structure that uses a centrifugal force to separate foreign materials from sucked air.

The suction unit 3 sucks dust or foreign materials, such as hair, on a cleaning surface, for example, on a carpet or floor.

Figure 3:
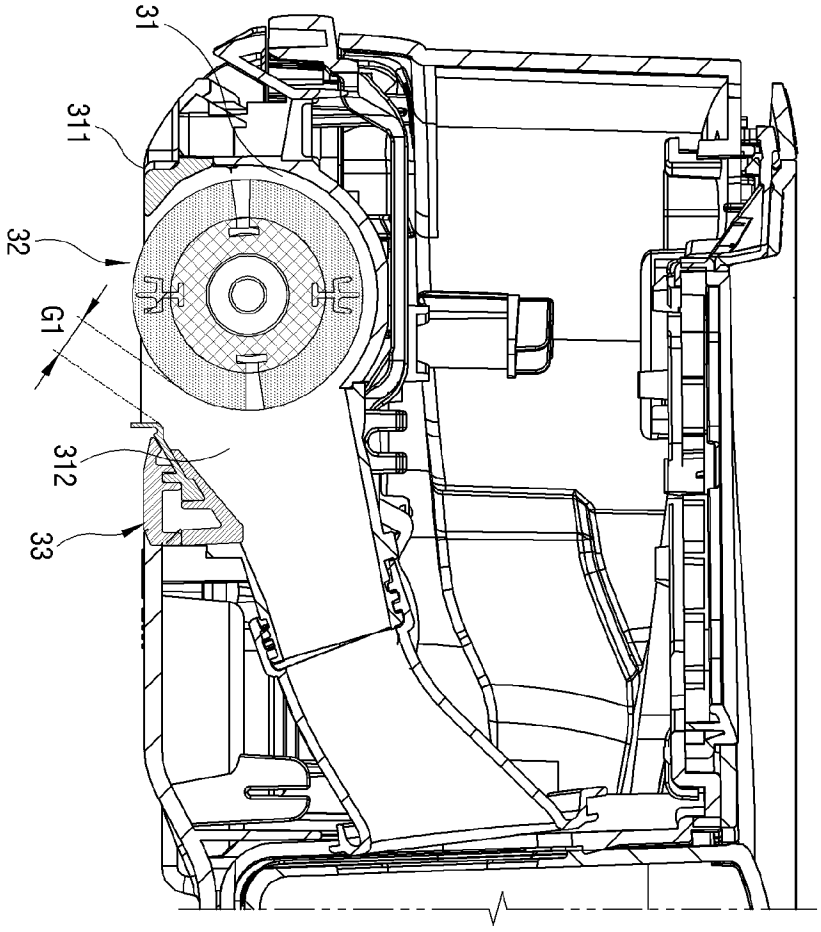
FIG. 3 is a cross-sectional view of a suction unit in FIG. 2 according to an embodiment of the disclosure.

FIG. 3 is a cross-sectional view of a suction unit in FIG. 2 according to an embodiment of the disclosure.

Figure 4:
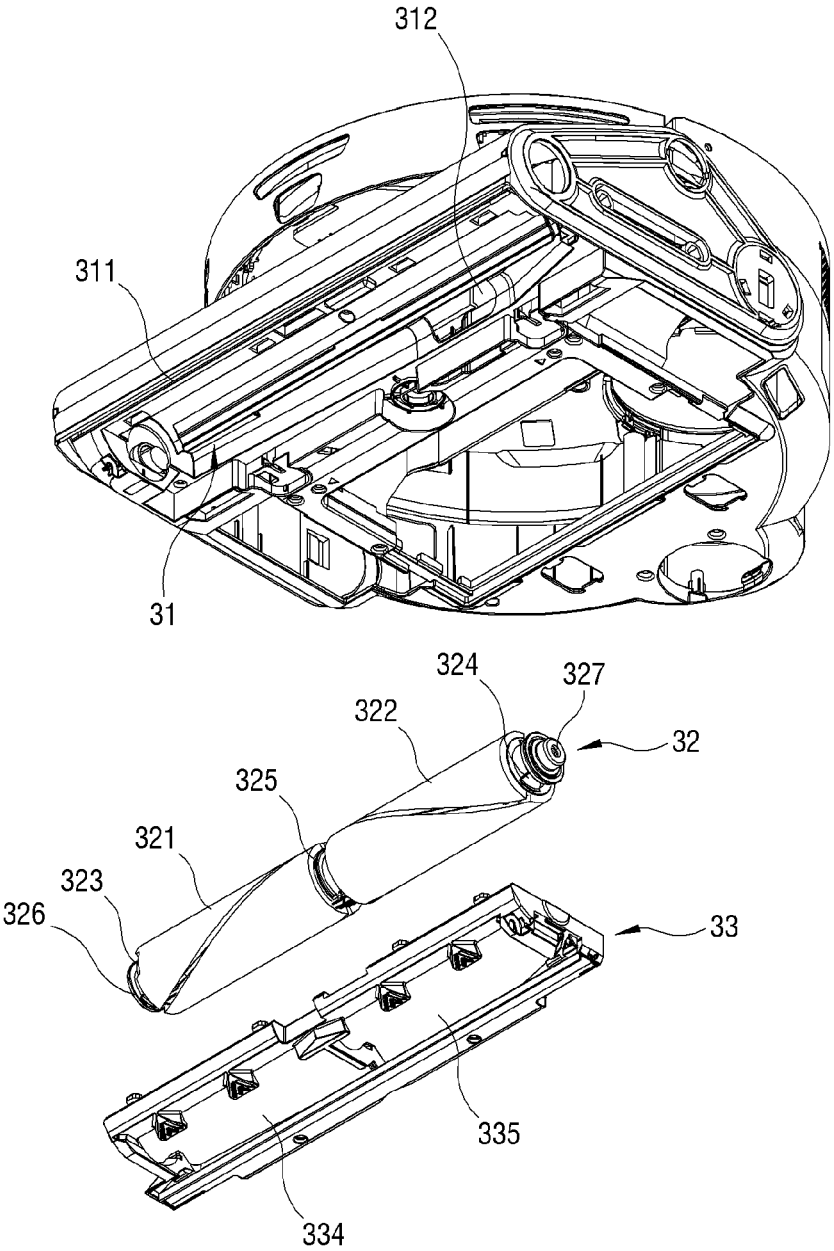
FIG. 4 is an exploded perspective view of the suction unit of FIG. 3 according to an embodiment of the disclosure.

FIG. 4 is an exploded perspective view of the suction unit of FIG. 3 according to an embodiment of the disclosure.

Referring to FIGS. 3 and 4, the suction unit 3 includes a suction chamber 31 opened toward the cleaning surface, a brush drum 32 provided in the suction chamber 31, and a brush cover 33 provided to cover an opening 311 of the suction chamber 31.

The suction chamber 31 is formed as recessed on the bottom of the cleaner body 2. The suction chamber 31 communicates with a suction passage 312 through which the sucked foreign materials are transferred to the cleaner body 2. In the suction chamber 31, the brush drum 32 is rotatably provided. Dust or foreign materials on the cleaning surface are transferred to the suction passage 312 by the suction force while passing between the brush drum 32 and an inner wall of the suction chamber 31.

The brush drum 32 partially protrudes to come into contact with the cleaning surface through the opening 311 of the suction chamber 31. The brush drum 32 rotates in an opposite direction to a moving direction of the robot cleaner 1, thereby pushing the foreign materials on the cleaning surface backwards.

The brush drum 32 includes first and second drum portions 321 and 322 arranged in a row side by side in a lengthwise direction, and first and second drum caps 326 and 327 provided at opposite ends. The brush drum 32 includes a first valley 323 provided between a first end of the first drum portion 321 and a first drum cap 326, a second valley 324 provided between a first end of the second drum portion 321 and the second drum cap 327, and a third valley 325 provided between a second end of the first drum portion 321 and a second end of the second drum portion 322. The brush drum 32 may be implemented by a single drum, or three or more drums.

The first and second drum portions 321 and 322 may be circumferentially covered with cotton flannel or the like material.

Typically, dust or foreign materials deeply attached to the carpet and the like materials are difficult to be sucked by suction using air. Therefore, the brush drum 32 rotates to shake off dust or foreign materials deeply attached between a plurality of hairs of the carpet, and scatters the dust or foreign materials above the carpet, so that such scattered dust or foreign materials may be sucked into the suction passage 312.

The brush cover 33 may be fixedly supported in the opening 311 of the suction chamber 31. The brush cover 33 includes first and second openings 334 and 335 provided in the middle thereof and having an approximately rectangular shape so that the brush drum 32 may partially protrude therefrom. The first and second openings 334 and 335 partially accommodate the first and second drum portions 321 and 322, respectively. In this case, a predetermined gap G1 is formed between the outer circumferential surface of the brush drum 32 and the inner surfaces of the first and second openings 334 and 335. Through the gap G1, the foreign materials on the cleaning surface are sucked into the suction passage 312.

Figure 5:
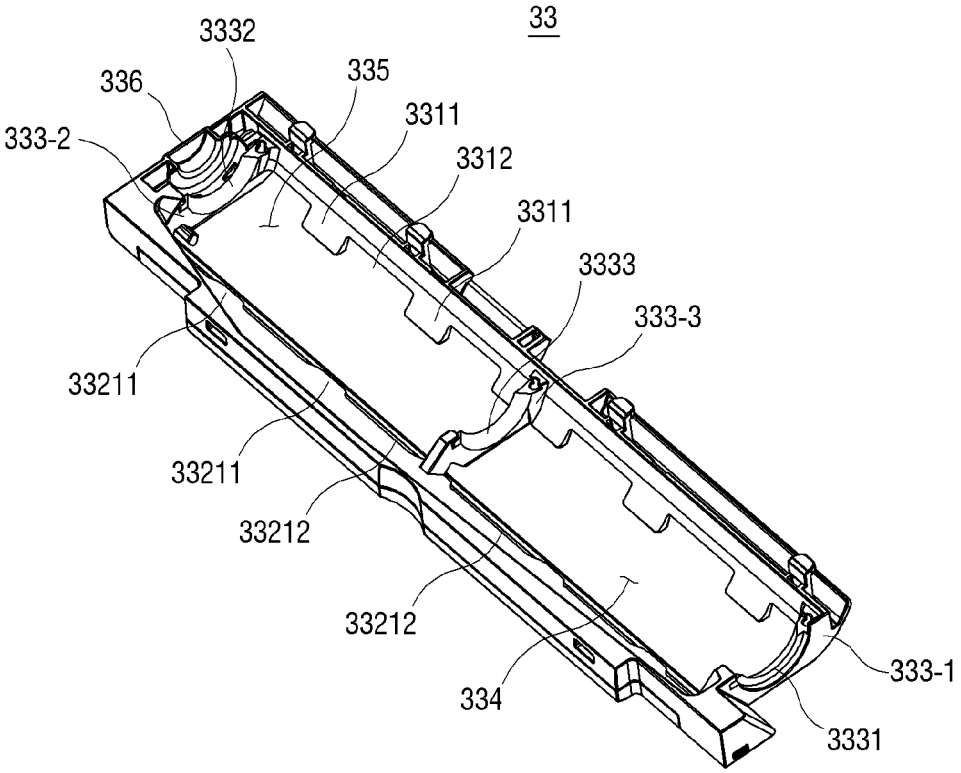
FIG. 5 is a perspective view of a brush cover in FIG. 4 according to an embodiment of the disclosure.

FIG. 5 is a perspective view of the brush cover in FIG. 4 according to an embodiment of the disclosure.

Figure 6:
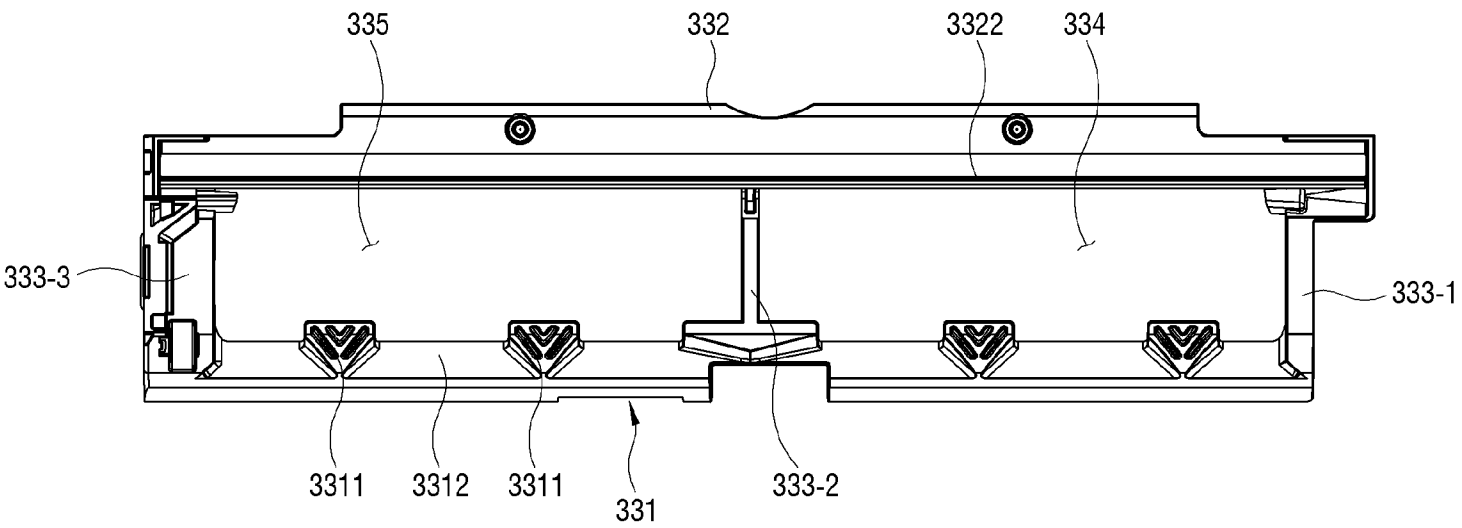
FIG. 6 is a bottom view of the brush cover in FIG. 5 according to an embodiment of the disclosure.

FIG. 6 is a bottom view of the brush cover in FIG. 5 according to an embodiment of the disclosure.

Figure 7:
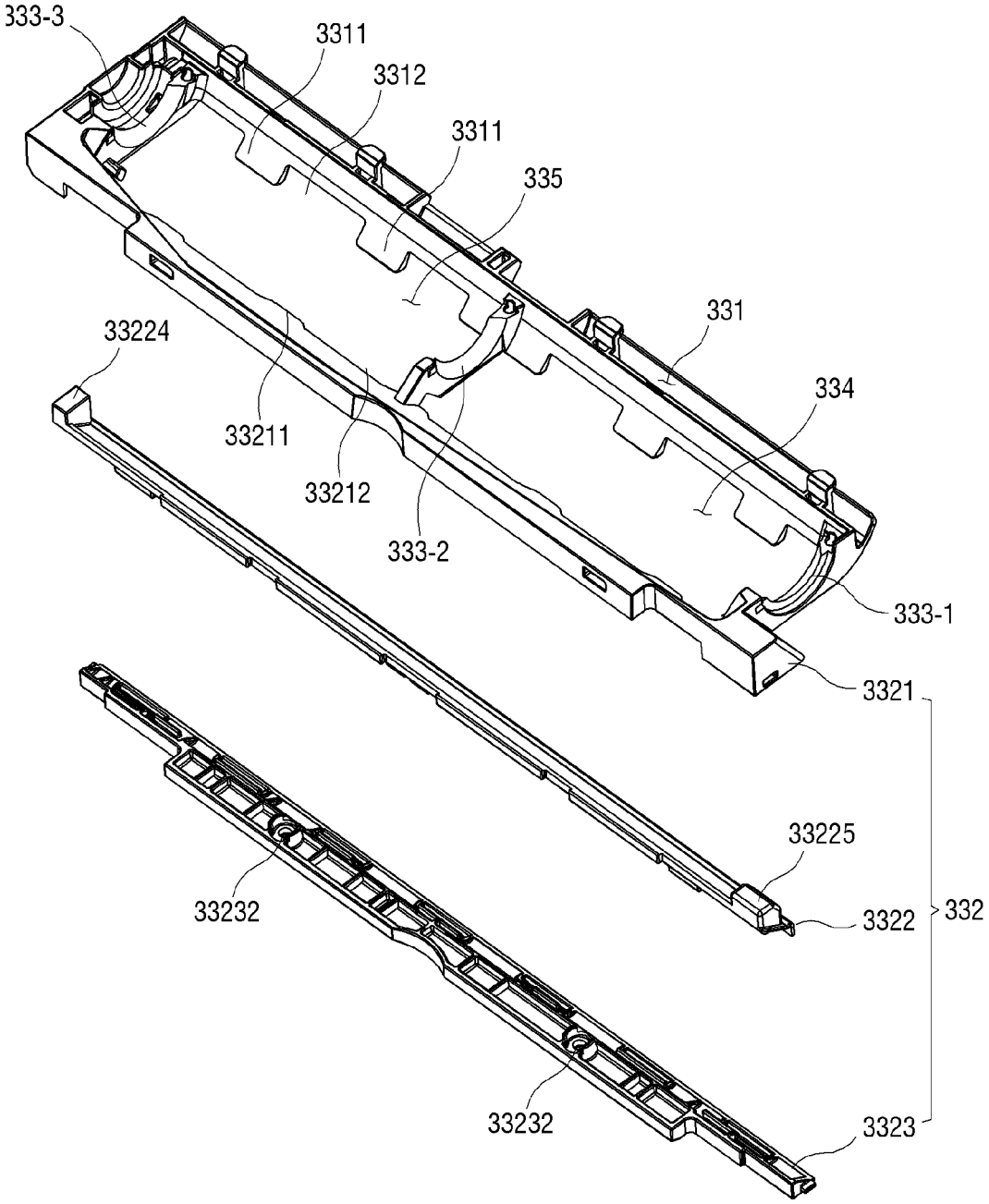
FIG. 7 is an exploded perspective view of a brush cover viewed from above according to an embodiment of the disclosure.

FIG. 7 is an exploded perspective view of a blade of the brush cover viewed from above according to an embodiment of the disclosure.

Figure 8:
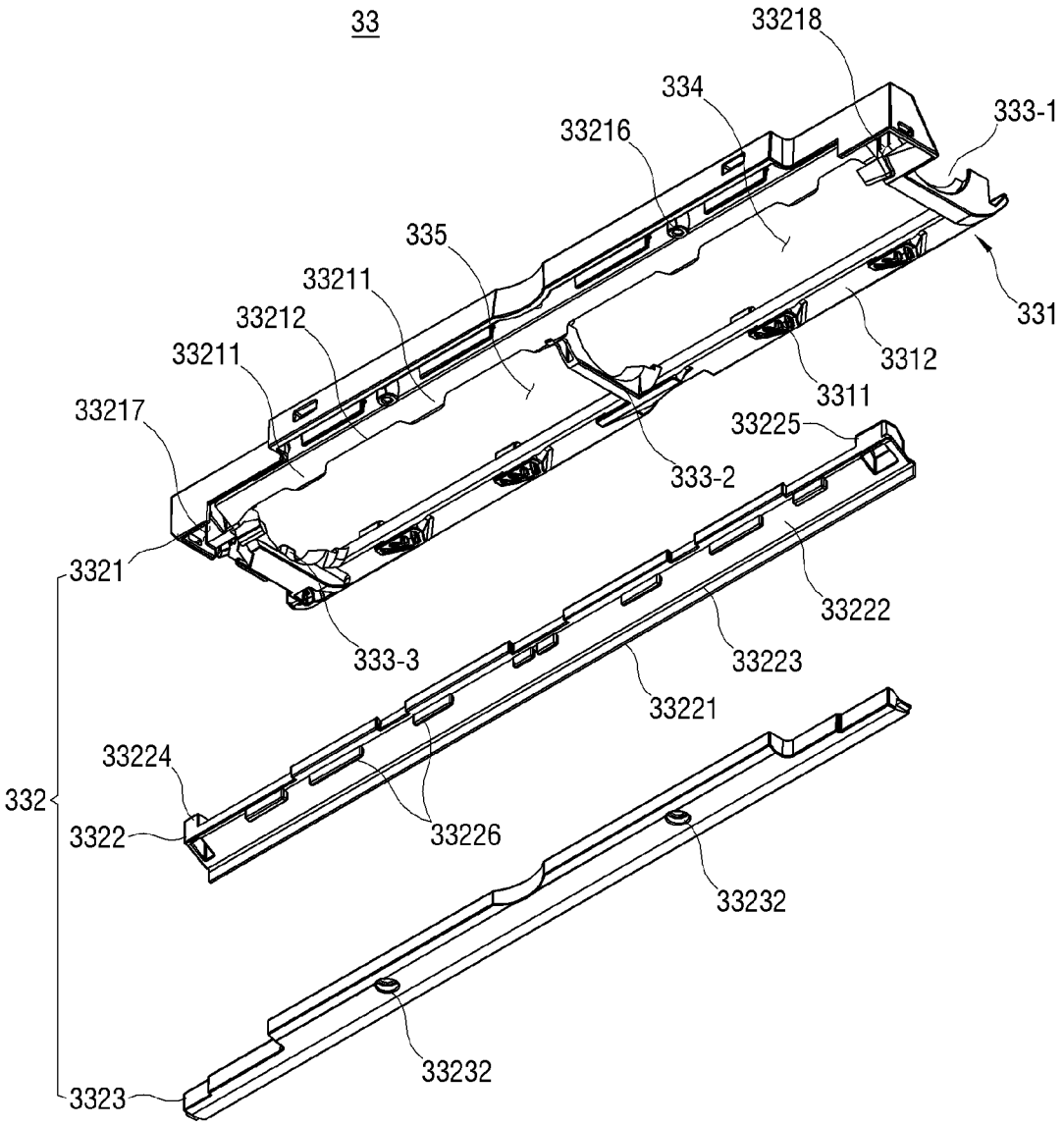
FIG. 8 is an exploded perspective view of a brush cover viewed from below according to an embodiment of the disclosure.

FIG. 8 is an exploded perspective view of a blade of the brush cover viewed from below according to an embodiment of the disclosure.

Figure 9:
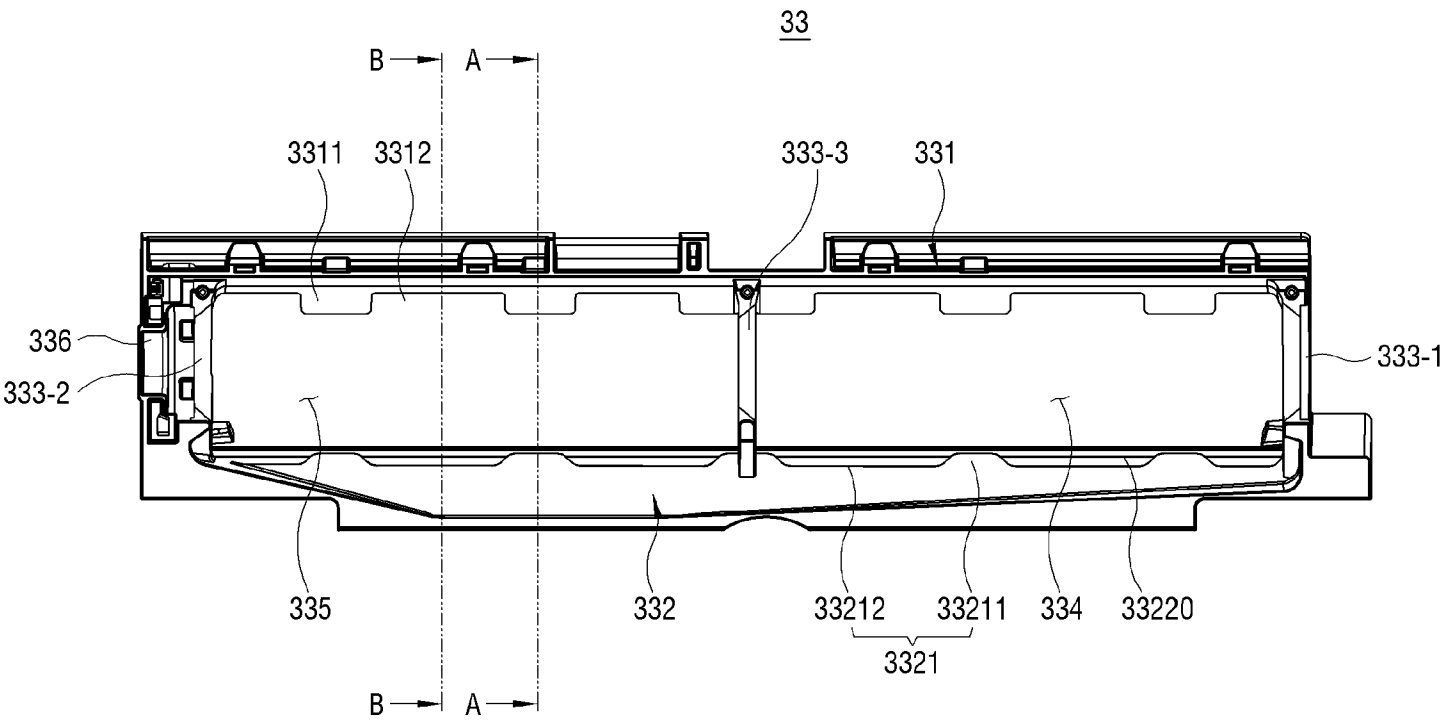
FIG. 9 is a plan view of the brush cover of FIG. 5 according to an embodiment of the disclosure.

FIG. 9 is a plan view of the brush cover of FIG. 5 according to an embodiment of the disclosure.

Figure 10:
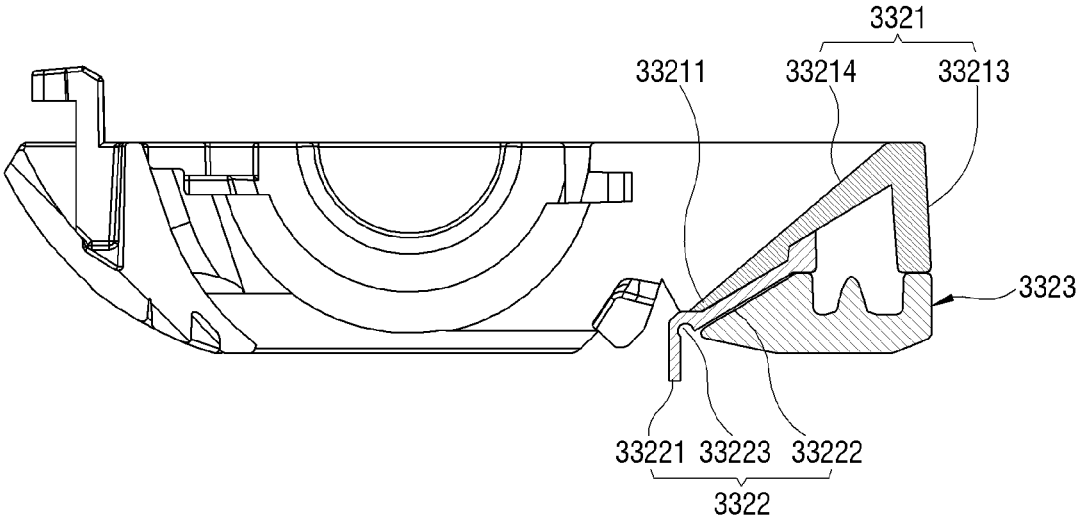
FIG. 10 is a cross-sectional view taken along line A-A in FIG. 9 according to an embodiment of the disclosure.

FIG. 10 is a cross-sectional view taken along line A-A in FIG. 9 according to an embodiment of the disclosure.

Figure 11:
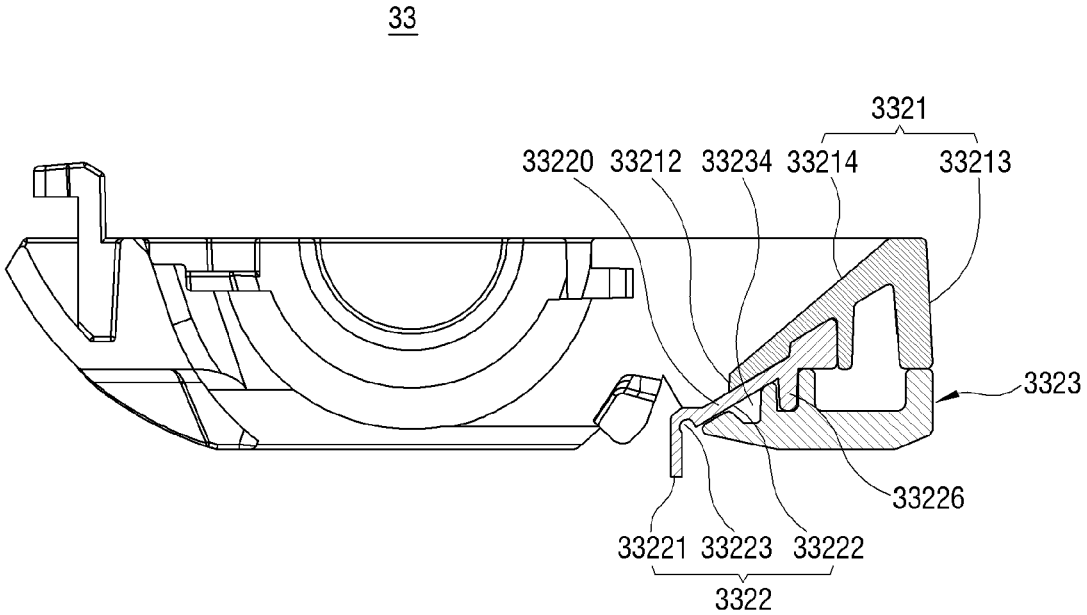
FIG. 11 is a cross-sectional view taken along line B-B in FIG. 9 according to an embodiment of the disclosure.

FIG. 11 is a cross-sectional view taken along line B-B in FIG. 9 according to an embodiment of the disclosure.

Figure 12:
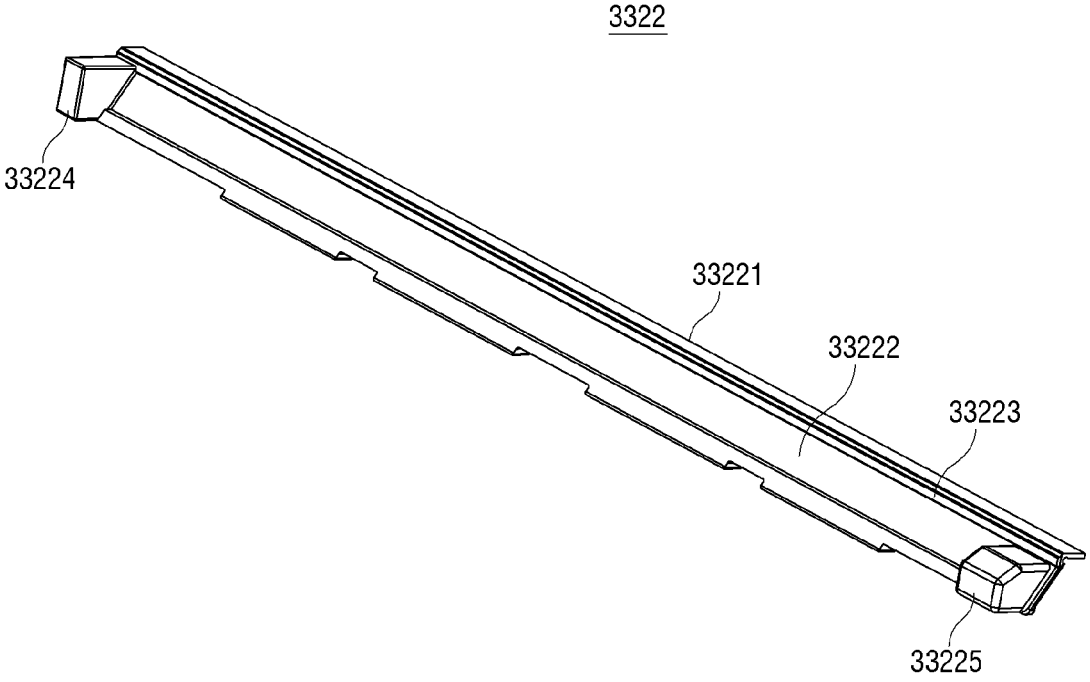
FIG. 12 is a perspective view of a blade in FIG. 7 viewed from above according to an embodiment of the disclosure.
Figure 13:
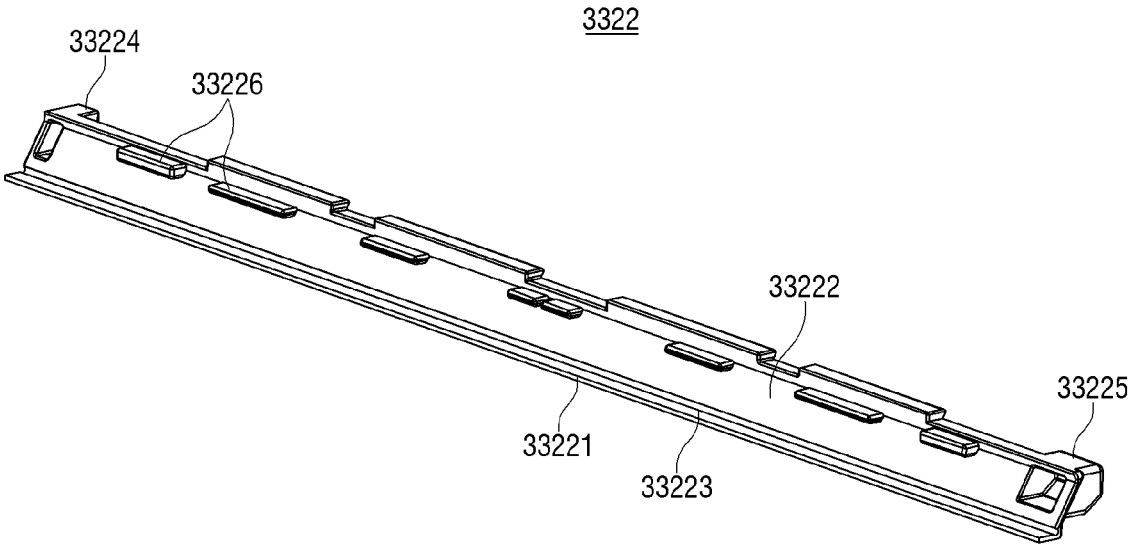
FIG. 13 is a perspective view of a blade in FIG. 7 viewed from below according to an embodiment of the disclosure.

FIG. 12 is a perspective view of the blade in FIG. 7 viewed from above according to an embodiment of the disclosure, FIG. 13 is a perspective view of the blade in FIG. 7 viewed from below according to an embodiment of the disclosure.

Figure 14:
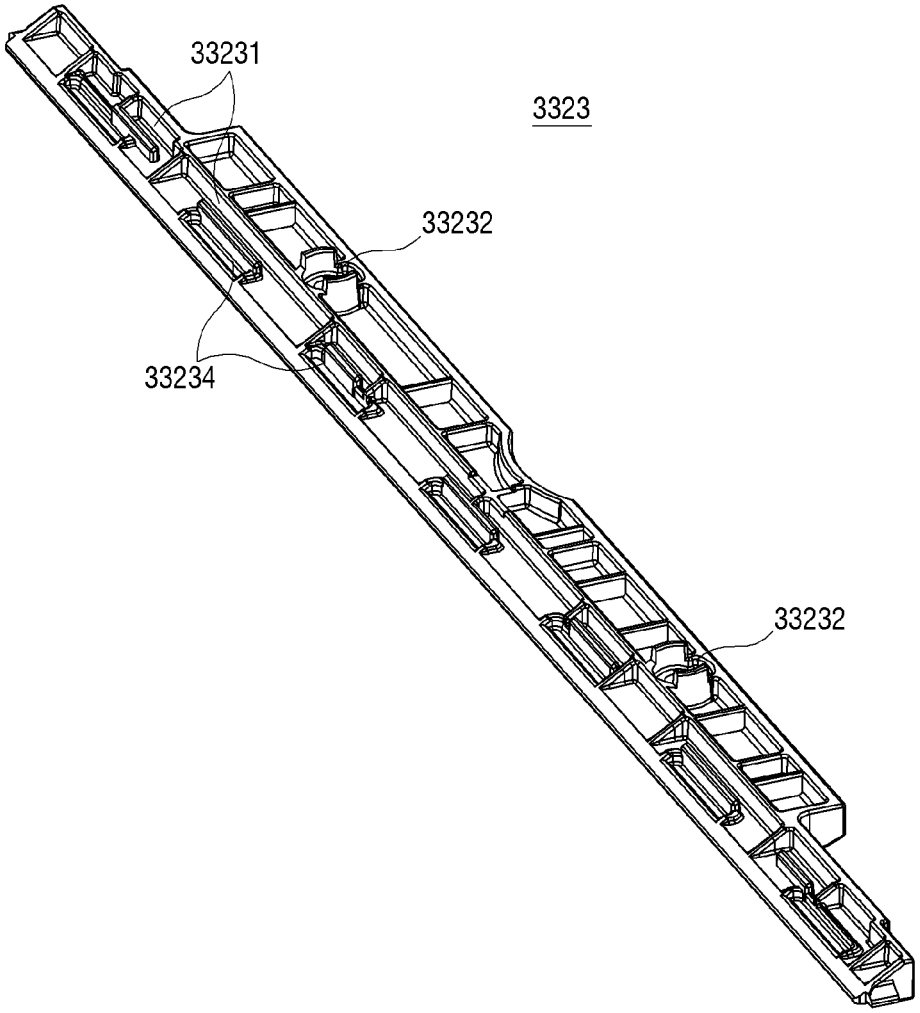
FIG. 14 is a perspective view of the blade cover of FIG. 8 according to an embodiment of the disclosure.

FIG. 14 is a perspective view of the blade cover of FIG. 8 according to an embodiment of the disclosure.

Referring to FIGS. 5 to 9, the brush cover 33 includes first and second openings 334 and 335 spaced from each other in a lengthwise direction and having an approximately rectangular shape.

The brush cover 33 includes a cap accommodating portion 336 provided at a short side of the first opening 335 and accommodating the second drum cap 327 (see FIG. 4) therein.

The brush cover 33 includes a front supporter 331, a rear supporter 332, and first to third connectors 333-1, 333-2 and 333-3 connecting the opposite ends and middles of the front supporter 331 and the rear supporter 332. The front supporter 331, the rear supporter 332, and the first to third connectors 333-1, 333-2 and 333-3 are used to form the first and second separated openings 334 and 335.

The front supporter 331 includes five protrusions 3311 spaced apart from each other and protruding downwards. Between the five protrusions 3311 is formed a passage 3312 through which foreign materials on the cleaning surface passes. As shown in FIG. 6, each protrusion 3311 has a triangular cross-section of which one vertex is disposed in a cleaning direction. Therefore, the passage 3312 is shaped to have a wide front and gradually narrow backwards. As shown in FIGS. 5 and 9, the five protrusions 3311 protrude toward the inside of the first and second openings 334 and 335. Because the passage 3312 communicates with the suction chamber 31, foreign materials passed through the passage 3312 sucked into the suction chamber 31. In this case, foreign materials that are not sucked into the suction chamber 31 are moved back by the rotation of the brush drum 32.

The rear supporter 332 includes the blade 3322 protruding toward the cleaning surface and extended in the lengthwise direction. The blade 3322 collects foreign materials passed through the passage 3312 and moved back by the rotation of the brush drum 32. Such collected foreign materials are sucked through the gap G1 (see FIG. 3) between the blade 3322 and the outer circumferential surface of the brush drum 32.

The first to third connectors 333-1, 333-2 and 333-3 include first to third semicircular grooves 3331, 3332 and 3333 formed corresponding to the first to third valleys 323, 324 and 325 of the brush drum 32. The first to third grooves 3331, 3332 and 3333 may be provided with cutters for cutting hair or the like wrapped around the first to third valleys 323, 324 and 325 of the brush drum 32.

Referring to FIGS. 7 and 8, the rear supporter 332 of the brush cover 33 may include a blade supporter 3321, the blade 3322, and a blade cover 3323. The blade 3322 may be mounted between the bottom of the blade supporter 3321 and the top of the blade cover 3323.

The blade supporter 3321 may be provided with the blade 3322 on the bottom thereof. The blade supporter 3321 may include fastening grooves 33217 and 33218 provided at opposite end portions on the bottom thereof and coupling with fastening protrusions 33224 and 33225 of the blade 3322, and a first screw fastening hole 33216.

Referring to FIGS. 10 and 11, the blade supporter 3321 includes a vertical portion 33213 erected vertically, and an inclined portion 33214 integrally connected to the vertical portion 33213 and extended inclining toward the openings 334 and 335.

The inclined portion 33214 of the blade supporter 3321 may include a plurality of concave-convex (凹凸) portions 33212 and 33211 formed on the blade 3322 toward the first and second openings 334 and 335 as shown in FIGS. 8 and 9. The convex (凸) portion 33211 supports and prevents the blade 3322 mounted to the bottom thereof from being deformed, and the concave (凹) portion 33212 provides a room for allowing the blade 3322 to be transformed by the sucked big foreign material. There may be five convex (凸) portions 33211 positioned corresponding to the protrusions 3311 of the front supporter 331. Of course, the number of convex (凸) portions 33211 may be less or more than five.

As shown in FIG. 10, the convex (凸) portions 33211 are extended up to a front end of the blade cover 3323 provided on the bottoms thereof side by side with the blade 3322 interposed therebetween. As a result, the convex (凸) portions 33211 hold and support the blade 3322 not to be deformed.

As shown in FIG. 11, the concave (凹) portions 33212 allow the blades 3322 to be partially exposed. As a result, the concave (凹) portions 33212 provide a transformation room in which the blade 3322 may be transformed.

The blade 3322 includes a transformable portion 33220 that may be transformed when a big foreign material is stuck between the blade 3322 and the brush drum 32. As shown in FIGS. 9 and 11, the transformable portion 33220 includes portions to be exposed through the concave (凹) portions 33212 of the blade supporter 3321.

As shown in FIG. 9, the concave (凹) portions 33212 are positioned corresponding to the passages 3312 between the protrusions 3311 of the front supporter 331. Therefore, a foreign material introduced through the passage 3312 is generally moved to the transformable portion 33220 of the blade 3322 positioned corresponding to the concave (凹) portion 33212.

As shown in FIG. 9, the convex (凸)portion 33211 is inclinedly formed having a lower portion wider than an upper portion. The concave (凹) portion 33212 is wider than the convex (凸) portion 33211. Such an inclined lateral surface of the convex ( 凸 ) portion 33211 allows an introduced foreign material to move toward the transformable portion 33220 of the blade 3322 even though the foreign material comes over to the blade 3322 positioned corresponding to the convex (凸) portion 33211. Further, the inclined lateral surface of the convex (凸) portion 33211 may prevent the transformable portion 33220 of the blade 3322 from being damaged when the transformable portion 33220 is transformed.

The concave-convex (凹凸) portions 33212 and 33211 may have an arc shape.

The blade 3322 may be made of an elastically transformable material such as natural rubber or synthetic rubber.

Referring to FIGS. 7, 8, 13, and 14, the blade 3322 includes the fastening protrusions 33224 and 33225 protruding from the opposite end portions thereof upwards, and a plurality of coupling protrusions 33226 protruding from the bottom thereof downwards. The fastening protrusions 33224 and 33225 are inserted in the fastening grooves 33217 and 33218 of the blade supporter 3321. The blade 3322 includes the fastening protrusions 33224 and 33225 inserted in the fastening grooves 33217 and 33218 of the blade supporter 3321, and the lower coupling protrusions 33226 inserted in a plurality of coupling grooves 33231 (see FIG. 14) of the blade cover 3323. In this state, the blade 3322 is mounted to the bottom of the blade supporter 3321 by fastening the first screw fastening hole 33216 of the blade supporter 3321 and a second screw fastening hole 33232 of the blade cover 3323 with screws.

As shown in FIGS. 10, 11, and 13, the blade 3322 may include a collector 33221 protruding toward the cleaning surface, a fixed portion 33222, and a bending connector 33223 provided between the collector 33221 and the fixed portion 33222.

The collector 33221 collects introduced foreign materials not to pass backwards while being in contact with the cleaning surface.

The fixed portion 33222 is interposed and fixedly supported between the blade supporter 3321 and the blade cover 3323.

The bending connector 33223 forms a predetermined space between the collector 33221 and the front end of the blade cover 3323 to increase a transformable range of the blade 3322 as shown in FIG. 11.

The blade cover 3323 holds and supports the blade 3322 disposed below the blade supporter 3321. The blade cover 3323 includes the coupling grooves 33231 to which the coupling protrusions 33226 of the blade 3322 are coupled.

As shown in FIG. 11, the blade cover 3323 includes a recessed portion 33234 provided at a position corresponding to the transformable portion 33220 of the blade 3322. The recessed portion 33234 may provide a room in which the transformable portion 33220 of the blade 3322 is transformed and accommodated.

Below, the operations of the blade 3322 according to an embodiment will be described.

Figure 15:
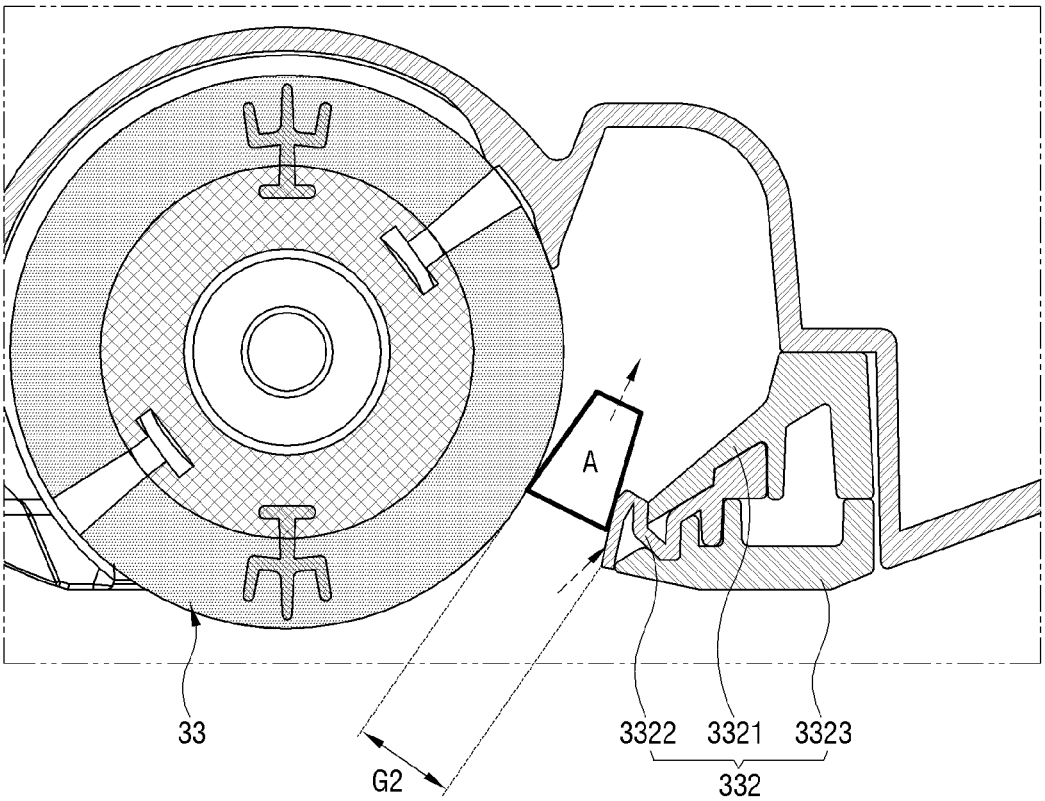
FIG. 15 illustrates a transformed state of a blade according to an embodiment of the disclosure.

FIG. 15 illustrates a transformed state of a blade according to an embodiment of the disclosure.

Figure 16:
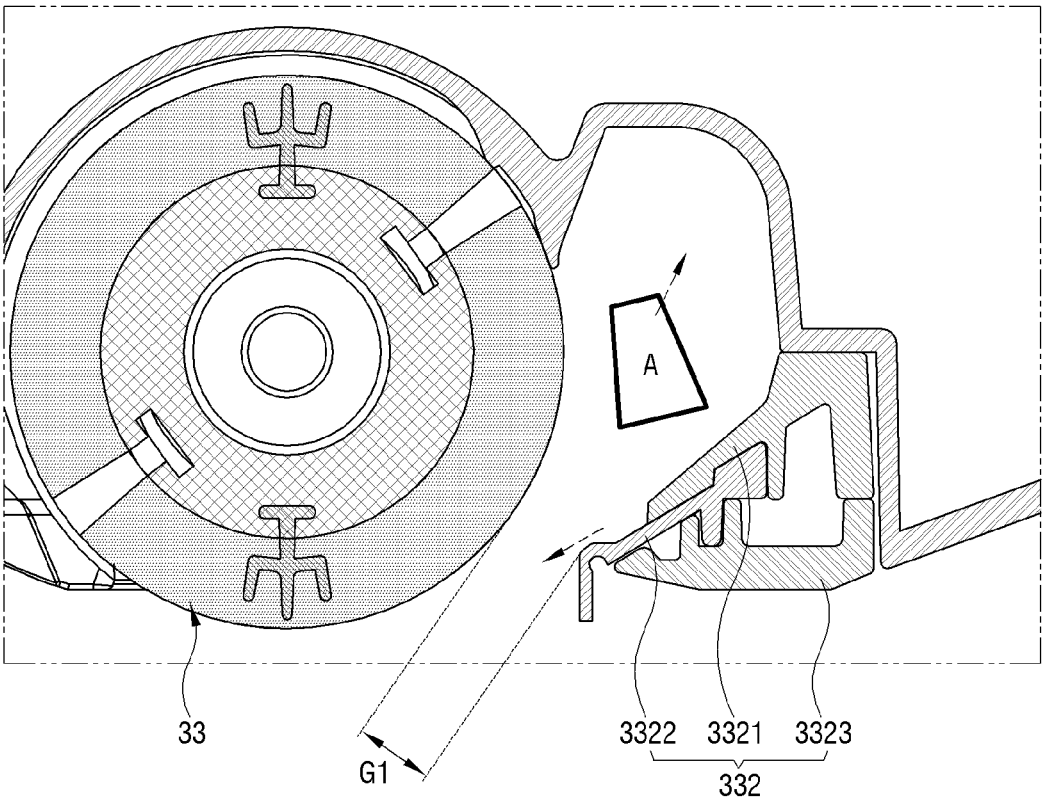
FIG. 16 illustrates a restored state of a blade according to an embodiment of the disclosure.

FIG. 16 illustrates a restored state of a blade according to an embodiment of the disclosure.

Referring to FIG. 15, a foreign material A enters between the blade 3322 and the brush drum 32 by a suction force. At this time, the blade 3322 is stretched upward and folded and inserted into the recessed portion 33234, and thus the gap G1 (see FIG. 16) may be extended into a gap G2. As a result, the foreign material A easily enters the suction passage 312 through the extend gap G2. When the blade 3322 is transformed, stress is applied to the blade 3322 to be restored by the convex (凸) portions 33211 provided at the opposite sides thereof.

Referring to FIG. 16, the transformed portion of the blade 3322 through which the foreign material A has passed is returned to its initial position.

As described above, the robot cleaner according to an embodiment is improved in suction performance as the gap G1 between the brush drum 32 and the blade 3322 is narrowed, and allows large and irregular foreign materials to pass as the gap is widened by partial transformation of the blade 3322.

As an alternative embodiment, the blade 3322 may be directly adhered or fastened to the blade supporter 3321 by adhesive or screws without using the blade cover 3323.

As an alternative embodiment, the blade 3322 may be mounted to the entrance of the suction chamber 31 instead of the brush cover 33.

As an alternative embodiment, the blade 3322 may be adhered or fastened to the convex (凸) portions 33212 and 33211.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A vacuum cleaner comprising:

a cleaner body generating a suction force; and a suction unit comprising a suction chamber having an opening configured to suck foreign materials by the suction force, wherein the suction unit comprises:

a brush drum partially protruding toward an outside of the suction chamber within the suction chamber and provided rotatably, and a blade provided to collect foreign materials as extended along an extending direction of the brush drum while being spaced apart leaving a gap from the brush drum inside the suction chamber, and comprising a flexible portion configured to flex to widen the gap, wherein the suction unit comprises a brush cover provided to cover a portion of the opening of the suction chamber, wherein the brush cover comprises a blade supporter supporting the blade to be extended parallel to a lengthwise direction of the brush drum while being spaced apart from the brush drum, wherein the blade supporter is fixed directly to at least one portion of a surface of the blade facing the brush drum, wherein the blade supporter is positioned between the at least one portion of the surface of the blade facing the brush drum and the brush drum, and wherein the blade supporter comprises a forward edge positioned on the at least one portion of the surface of the blade facing the drum, with the forward edge defining a plurality of alternating recessed and protruding portions provided along a lengthwise direction of the blade.

2. The vacuum cleaner of claim 1, wherein the blade comprises an elastically flexible material.

3. The vacuum cleaner of claim 2, wherein the brush drum partially protrudes through the brush cover.

4. The vacuum cleaner of claim 2, wherein the blade comprises:

a collector facing toward a cleaning surface to collect foreign materials; and a fixed portion being connected to the collector and formed at an angle thereto, and supported on the brush cover.

5. The vacuum cleaner of claim 2, wherein the suction unit comprises a blade cover fixed to the blade supporter with the blade therebetween.

6. The vacuum cleaner of claim 4, wherein the blade comprises a bending connector provided between the collector and the fixed portion and spacing the collector from the blade cover.

7. The vacuum cleaner of claim 1, wherein each of the recessed portions of the plurality of alternating recessed and protruding portions has a wider width than each of the protruding portions of the plurality of alternating recessed and protruding portions.

8. The vacuum cleaner of claim 1, wherein each of the protruding portions of the plurality of alternating recessed and protruding portions tapers inward away from each of the respective adjacent recessed portions of the plurality of alternating recessed and protruding portions.

9. The vacuum cleaner of claim 1, wherein the brush cover comprises a front supporter with the opening is between the front supporter and the blade supporter, and wherein the front supporter comprises:

a plurality of protrusions spaced apart from each other in a lengthwise direction and protruding downwards, and a plurality of passages provided between the plurality of protrusions and allowing foreign materials to be introduced.

10. The vacuum cleaner of claim 9, wherein a total number of protruding portions of the plurality of alternating recessed and protruding portions is equal to the number of protrusions.

11. The vacuum cleaner of claim 9, wherein each recessed portion of the plurality of alternating recessed and protruding portions is provided at a position corresponding to a passage of the plurality of passages.

12. The vacuum cleaner of claim 1, wherein the flexible portion of the blade comprises a portion exposed adjacent to each of the recessed portions of the plurality of alternating recessed and protruding portions.

13. The vacuum cleaner of claim 1, wherein the blade comprises a fastening protrusion disposed at each end of the blade.

* * * * *